US007377296B2

(12) United States Patent
Gueret

(10) Patent No.: US 7,377,296 B2
(45) Date of Patent: May 27, 2008

(54) DEVICE FOR PACKAGING AND DISPENSING A COSMETIC OR ANOTHER CARE PRODUCT

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 399 days.

(21) Appl. No.: 10/937,399

(22) Filed: Sep. 10, 2004

(65) Prior Publication Data

US 2005/0056343 A1 Mar. 17, 2005

Related U.S. Application Data

(60) Provisional application No. 60/511,107, filed on Oct. 15, 2003.

(30) Foreign Application Priority Data

Sep. 12, 2003 (FR) ..... 03 10746

(51) Int. Cl.
*B65B 1/04* (2006.01)

(52) U.S. Cl. ..... 141/352; 141/113; 141/346; 401/125

(58) Field of Classification Search ..... 141/20, 141/113, 346, 352; 401/123–125
See application file for complete search history.

(56) References Cited

U.S. PATENT DOCUMENTS 2,183,662 A * 12/1939 Warr et al. ..... 222/187
2,311,367 A * 2/1943 Chambers ..... 401/119
2,699,885 A * 1/1955 McClure ..... 141/320
3,142,319 A * 7/1964 Russo et al. ..... 141/113
3,203,454 A * 8/1965 Micallef ..... 141/113
3,256,549 A * 6/1966 Evesque ..... 401/190
3,370,756 A 2/1968 McKinnie
3,841,532 A * 10/1974 Gores ..... 222/205
4,089,609 A 5/1978 Gring et al.
4,349,129 A * 9/1982 Amneus ..... 222/41
6,334,727 B1 1/2002 Gueret

FOREIGN PATENT DOCUMENTS

EP 1 086 904 A1 3/2001
EP 1 205 125 A2 5/2002
EP 1 205 126 A1 5/2002
FR 2 829 116 3/2003
GB 2 137 181 A 10/1984
JP U-64-32388 2/1989

* cited by examiner

*Primary Examiner*—Timothy L. Maust
(74) *Attorney, Agent, or Firm*—Oliff & Berridge, PLC

(57) ABSTRACT

A device for packaging and dispensing a product includes: a unit that can be refilled with product using a container having a dispenser member, the unit comprising: a body; an element that can be refilled with product comprising a product application surface; and, a filling valve that is attached to the body and configured to pass from a closed configuration to a filling configuration under the effect of a thrust exerted by the dispenser member, and to return to the closed configuration in the absence of the dispenser member.

44 Claims, 6 Drawing Sheets

DEVICE FOR PACKAGING AND DISPENSING A COSMETIC OR ANOTHER CARE PRODUCT

This non provisional application claims the benefit of French Application No. 03 10746 filed on Sep. 12, 2003 and U.S. Provisional Application No. 60/511,107 filed on Oct. 15, 2003, the entire disclosures of which are incorporated by reference herein.

FIELD OF INVENTION

The present invention relates to devices for packaging and dispensing a cosmetic or another care product. In particular, the devices may be of the type comprising a unit that can be refilled with product using a container having a dispenser member comprising, for example, a valve or pump stem.

BACKGROUND

Such devices are known, for example, from European patent applications EP 1,205,125-A2 and EP 1,205,126-A1. In these known devices, the refillable unit may optionally comprise a filling valve, which can be in the form of an elastomeric flap that is integral with the body of the unit and can go from a closed configuration to a filling configuration under the effect of the pressure from the product coming from the container.

SUMMARY OF THE INVENTION

A unit with such a filling valve may prove to be relatively difficult to produce. Furthermore, the pressure from the product delivered by the dispenser member of the container must be sufficient to open the flap, which limits the use of the unit to special containers, and may reduce the number of products that can be introduced into the unit by the consumer.

Exemplary embodiments of the invention aim to propose a packaging and dispensing device in which the refillable unit may be easily produced and in which the refillable unit may be used with a container comprising a dispenser member that delivers the product with a pressure that is not necessarily very high.

Exemplary embodiments of the invention provide a device for packaging and dispensing a cosmetic product, the device comprising: a unit that can be refilled with product using a container having a dispenser member, the unit comprising: a body; an element that can be refilled with product; and, a filling valve that is attached to the body and configured, on the one hand, to pass from a closed configuration to a filling configuration, under the effect of a thrust exerted by the dispenser member and, on the other hand, to return to its closed configuration in the absence of the dispenser member.

In exemplary embodiments, the refillable element comprises an application surface, which may be configured to come into contact with the skin.

By virtue of exemplary embodiments of the invention, the filling valve may be opened irrespective of the pressure with the product is delivered by the container, thus making it easier to fill the refillable unit.

In exemplary embodiments, the dispenser member of the container may, for example, comprise a dispenser valve, especially in the case of a pressurized container or a pump, and a corresponding valve or pump stem.

In exemplary embodiments, the packaging and dispensing device according to the invention may comprise not only the refillable unit, but also the container designed to refill the refillable unit.

In exemplary embodiments, the stem may be movable with respect to the container along its axis between a rest position and a position for dispensing the product.

The force necessary to cause the filling valve to go from the closed configuration to the filling configuration may be less than or equal to the force necessary to make the stem go from its rest position to its dispensing position.

The force necessary to cause the stem to go from its rest position to its dispensing position may be between about 10 daN and about 15 daN, for example.

The filling valve may be configured to take up the filling configuration before the dispenser member delivers any product into the product-refillable unit.

In exemplary embodiments, the filling valve may be made as a single piece by moulding a material, for example, an elastomer. However, it is also contemplated that the filling valve may be made by assembling several components. The filling valve may, for example, comprise an endpiece designed to cooperate with the dispenser member, wherein the endpiece is movable relative to an elastomer part.

The filling valve may be attached to the body of the refillable unit, which may make the body easier to produce.

The body of the refillable unit may have an aperture passing through it, the filling valve being placed in this aperture.

The aperture may be located in a depression opening out into the internal space of the unit. The depression may allow, for example, the filling valve not to project too much inside the refillable unit and, for example, may make it possible to prevent contact between the filling valve and the product-refillable element, as appropriate. It may also be that the filling valve does not protrude from the depression.

In embodiments in which the filling valve comprises a movable part, the presence of the depression may, for example, give the movable part enough room to move to allow the movable part to take up the filling configuration without being hindered by the product-refillable element.

The filling valve may comprise an elastic return member for returning the filling valve automatically to the closed configuration when the dispenser member of the container is uncoupled from the filling valve.

The elastic return member may, for example, be in the form of a lip made as a single piece with a stopper-forming part of the filling valve. The stopper-forming part may be movable in the corresponding aperture in the body.

The return member may also be in the form of a spring that is not made as a single piece with the stopper-forming part. For example, the return member may be a helical spring that is elastically interposed between an outer surface of the body of the unit and a shoulder made on the stopper-forming part of the filling valve.

The stopper-forming part may comprise at least one orifice that is closed off by the body of the refillable unit when the valve is in the closed configuration and that opens out into the internal space of the unit when the valve is in the filling configuration. For example, the stopper-forming part may comprise at least two diametrically opposed and coaxial orifices.

The stopper-forming part, especially in embodiments in which the stopper-forming part can move relative to the body, may comprise at least one boss making it possible to reduce the extent of the contacting surfaces of the filling valve and of the body so as to allow the filling valve to move relative to the body more easily, e.g., with less friction.

The filling valve may comprise at least one annular boss, for example, at least two annular bosses, that may preferably be placed on either side of the orifice(s) through which the product passes before reaching the internal space during filling.

Such bosses may be placed in contact with the wall defining the aperture in which the filling valve is engaged, when the valve is in the closed configuration.

The filling valve may also comprise a fixed part placed in the aperture and a stopper-forming part that can move relative to the fixed part under the effect of a thrust exerted by the dispenser member of the container, such as, for example, a thrust exerted by the stem of a pump or a valve bearing against the stopper-forming part so as to push the stopper-forming part away from the fixed part. The stopper-forming part may, for example, be articulated to the fixed part via a hinge-forming part.

The filling valve may comprise a head for retaining the filling valve in the body of the refillable unit. The head may have, for example, a wall that is thinner at its periphery and capable, for example, of being raised to facilitate the flow of the product dispensed by the container. Alternatively, the head may have an annular lip that bears via its free edge against the body of the unit.

The product-refillable element in the unit may comprise, for example, an applicator member. The applicator member may possibly be, for example, integral with a grip member fastened removably to the body or integral with the body. In the latter case, the product dispensed by the container in the unit may have to pass through the applicator member to reach an application surface for applying the product to the surface to be treated, for example, the skin, the mucous membranes or the integuments.

The applicator member may optionally be in contact with the filling valve when the latter is in the closed configuration and the removable unit is closed.

The applicator member may comprise a wide range of materials, for example, an elastically deformable element, especially a foam.

The unit may comprise a removable and/or foldable handle.

The unit may comprise a grid inserted between the product-refillable element and the filling valve.

The container may comprise a dip tube. Alternatively, the container may comprise a piston and a dispenser member, such as a pump, of the airless type.

Exemplary embodiments of the invention also provide a device for packaging and dispensing a product, the device comprising: a unit that can be refilled with product using a container having a dispenser member, the unit comprising: a body; an element that can be refilled with product, contained in an internal space of the unit, delimited at least partially by the said body; a filling valve that is attached to the body and configured to pass from a configuration in which the filling valve closes off the internal space to a filling configuration, under the effect of a thrust exerted by the dispenser member, and to return to its closed configuration in the absence of the dispenser member.

BRIEF DESCRIPTION OF THE DRAWINGS

The invention may be more clearly understood on reading the following detailed description of non-limiting exemplary embodiments thereof, and on examining the accompanying drawings, in which.

DETAILED DESCRIPTION OF EXEMPLARY EMBODIMENTS

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

Figure 1:
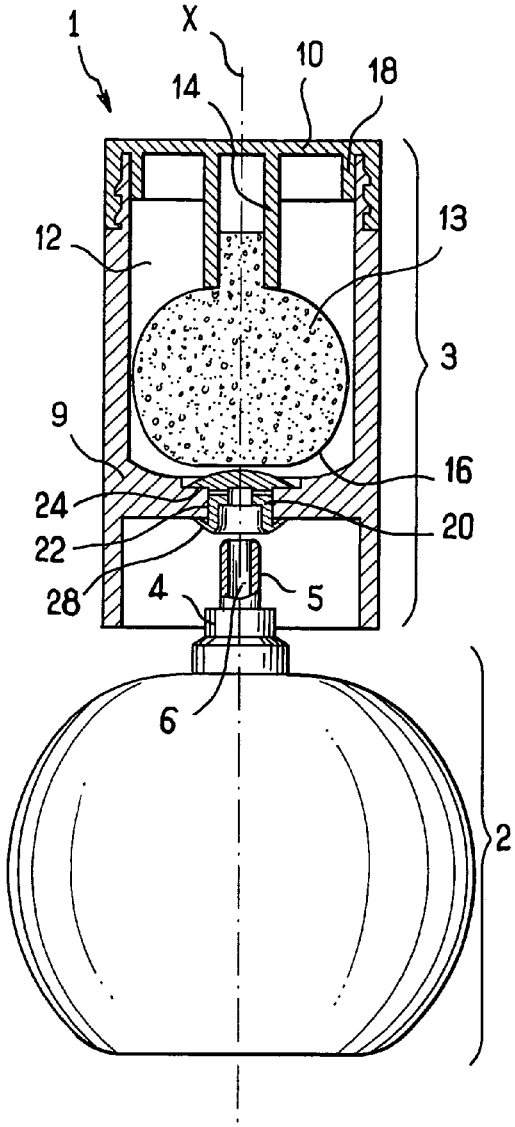
FIG. 1 is a schematic view, in partial longitudinal section, of an exemplary device made according to the invention, the filling valve being in its closed configuration.
Figure 2:
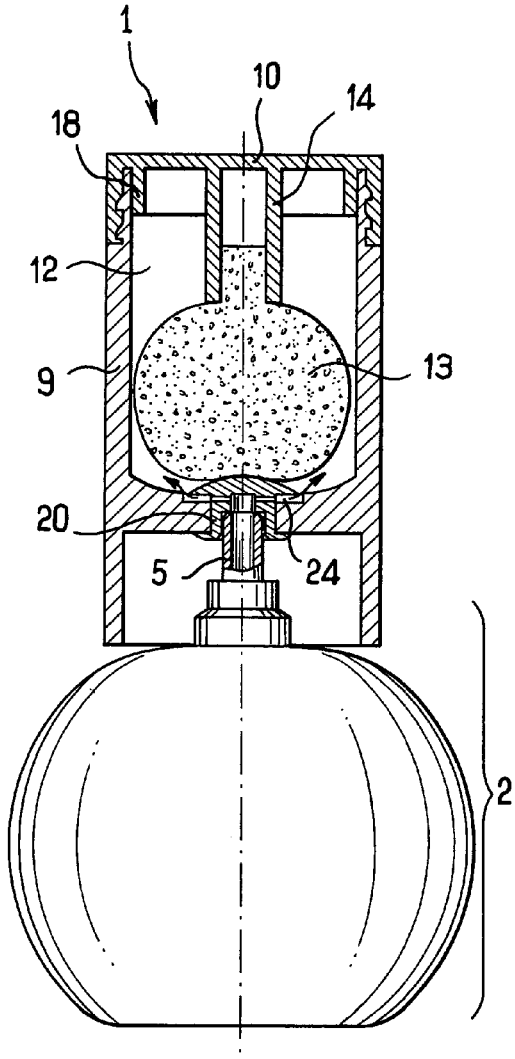
FIG. 2 shows the device of FIG. 1 when the filling valve is in its filling configuration.
Figure 3:
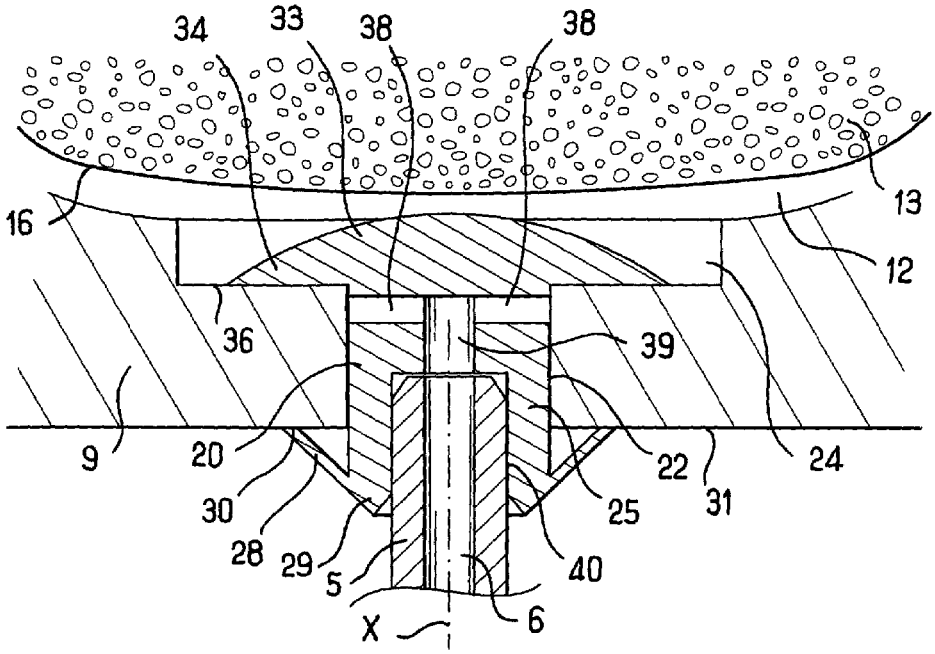
FIG. 3 shows, on a larger scale, a partial sectional detail of FIG. 1.

A packaging and dispensing device 1 shown in FIGS. 1 to 3 comprises a container 2 containing a cosmetic product, such as a face care or body care product, for example, a milk, lotion or perfume, and a unit 3 that can be refilled with the product delivered by the container 2. The unit 3 may be fastened removably to the container 2.

The container comprises a dispensing member 4 comprising, in this exemplary embodiment, a hollow stem 5 that may belong to a pump or valve. In the exemplary embodiment, the product is dispensed by the stem 5 being pushed in along the longitudinal axis X of the device, the product being dispensed via an inner duct 6 of the stem 5. The force necessary to push in the stem far enough to cause the product to be dispensed is, for example, greater than about 10 daN, being, for example, on the order of 12 daN. The product may also be dispensed in another way, either known or hereafter developed. For example, the product may be dispensed by operating a push-button separate from the stem or by pressing on a wall of the container, the stem being fixed, as appropriate.

The pump or valve constituting the dispensing member 4 may be of any known type. The container 2 has been shown schematically and the invention is not limited to any particular size or shape of container. For example, the container 2 may be considerably bigger than the refillable unit 3.

The unit 3 may comprise a hollow body 9 defining, with a closure cover 10, an internal space 12 housing a product-refillable element 13. This element 13 comprises, in the exemplary embodiment, an applicator member fastened to the cover 10. The applicator member 13 may, for example, be a foam fastened to one end of a central channel 14 of the cover 10, the applicator member 13 possibly having an application surface 16 of any shape, especially outwardly convex.

As in the exemplary embodiment shown in the figures, the cover 10 may advantageously comprise a sealing lip 18 for hermetically sealing the internal space 12.

According to the various exemplary embodiments of the invention, the unit 3 comprises a filling valve 20 designed to cooperate with the stem 5 and go from a configuration in which the filling valve 20 closes off the internal space 12, shown in FIG. 1, to a filling configuration, shown in FIG. 2, in which the product dispensed by the container 2 can reach the internal space 12 so as to fill the applicator member 13 with product.

In the exemplary embodiment, the filling valve 20 is engaged in an aperture 22 in the body 9, as shown for example in FIG. 3.

This aperture 22 may be, for example, in the shape of a cylinder that is axisymmetric about the axis X and can open out, as illustrated, in a depression 24 in the inside surface of the body 9.

The filling valve 20 may have a stopper-forming part 25 that can move in the aperture 22 along the axis X, and an elastic return member 28 for returning the stopper-forming part 25 to the closure configuration when the stem 5 is withdrawn from the filling valve 20.

The return member 28 may be, for example, in the form of an annular lip joined to the outer end 29 of the stopper-forming part 25 and extending radially outward in the direction of the body 9 until the lip bears via its free edge 30 against the outer surface 31 of the body 9.

As shown in FIG. 3, the stopper-forming part 25 may comprise a retaining head 33 for retaining the filling valve on the body 9. The head 33 may comprise, for example, a wall 34 that is thinner at its periphery, bearing against the bottom 36 of the depression 24 when the filling valve is in its closed configuration.

The stopper-forming part 25 may also comprise at least one orifice 38, for example, two diametrically opposed and coaxial orifices 38, communicating with an inner duct 39 that opens out in the end wall of a housing 40 for receiving the stem 5 and that lies in the extension of the inner duct 6 of the stem 5 when the stem 5 is engaged in the filling valve 20, as shown in FIG. 3.

When the filling valve 20 is in its closed configuration, the orifices 38 open out opposite the wall of the body 9 defining the aperture 22 and the orifices 38 are thus closed off. The filling valve 20 can then cut off the internal space 12 from the ambient air.

As appropriate, the retaining head 33 may also help to obtain a hermetic seal by pressing in a substantially leaktight manner against the bottom 36 of the depression 24. In various embodiments, the closure can be made leaktight merely by the retaining head 33 pressing against the bottom 36 of the depression 24, the orifices 38 not being closed off by the body 9.

When the stem 5 is pushed into the filling valve 20 and the unit 3 is moved downward to actuate the stem 5 and cause the product to be dispensed via the stem 5, the stopper-forming part 25 moves in a limited manner relative to the body 9 and the orifices 38 can open out into the depression 24.

The retaining head 33 is separated from the bottom 36 of the depression 24, allowing the product dispensed via the stem 5 to reach the internal space 12 of the container more easily. When the unit 3 is released and/or the stem 5 withdrawn from the filling valve 20, the filling valve 20 returns to the closed configuration shown in FIG. 1, for example, by virtue of the return member 28.

Thus, the product inside the unit 3 can be stored in a hermetically sealed environment, which is especially advantageous when the product comprises a volatile compound, such as a perfume.

Preferably, the filling valve 20 may be made such that the orifices 38 open out into the depression 24 before the product is dispensed via the stem 5.

In the exemplary embodiment of FIGS. 1 to 3, the filling valve 20 may be made as a single piece by moulding a thermoplastic, for example, an elastomer.

Naturally, various modifications may be made, for example, to the filling valve, without departing from the scope of the present invention.

Figure 4:
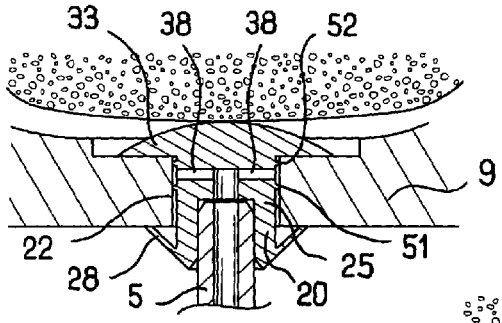
FIGS. 4 to 13 are partial sectional details of various embodiments of the filling valve.

For example, FIG. 4 shows another embodiment in which the stopper-forming part 25 comprises two annular bosses 51 and 52 situated respectively on either side of the orifices 38.

The stopper-forming part 25 is then in contact with the wall of the body 9 defining the aperture 22 essentially via these bosses 51 and 52, which may make it possible to reduce the friction between the stopper-forming part 25 and the body 9 and thus facilitate the movement of the stopper-forming part 25 under the effect of a thrust exerted by the stem 5.

Figure 5:
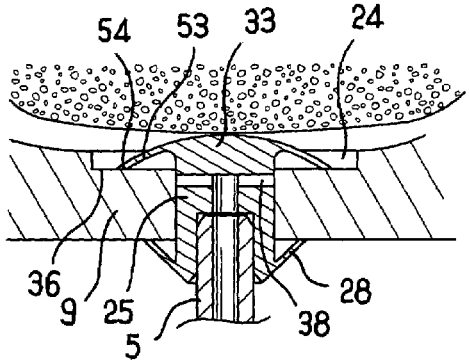

In the exemplary embodiment shown in FIG. 5, the retaining head 33 comprises at its periphery an annular lip 53 that presses via its free edge 54 against the bottom 36 of the depression 24.

The retaining head 33 may of course be made with yet other shapes. Preferably, the head 33 is made with a shape that facilitates the insertion of the filling valve 20 in the aperture 22.

Figure 6:
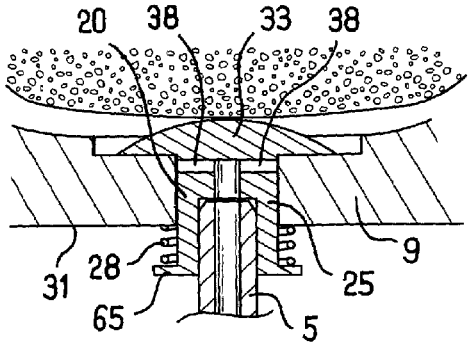

In the exemplary embodiment illustrated in FIG. 6, the return member 28 comprises a helical spring placed around the stopper-forming part 25. The spring bears at one axial end against the outer surface 31 of the body 9 and at the other end against a circular flange 65 made at the outer end of the stopper-forming part 25.

Figure 7:
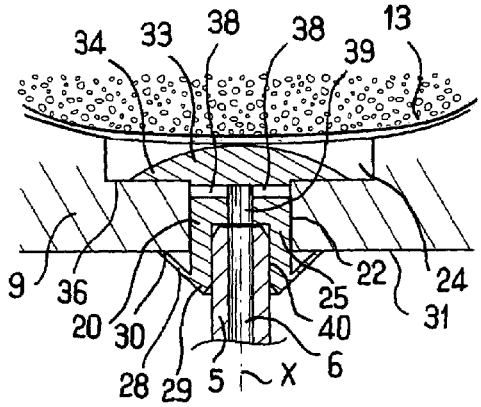

As shown in FIG. 7, the filling valve 20 may be made such that the filling valve 20 does not protrude from the depression 24 when at rest.

Figure 8:
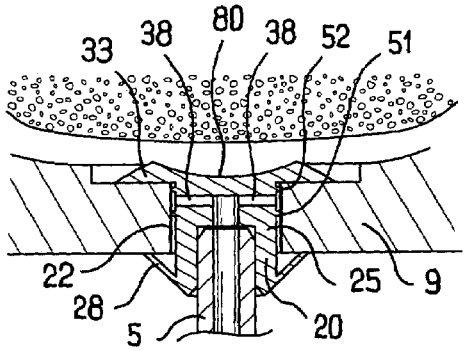

As appropriate, as illustrated in FIG. 8, for example, the filling valve 20 may be made as a function of the shape and position of the product-refillable element inside the unit.

The filling valve may thus, for example, be made with a face 80 that is concave toward the product-refillable element.

Figure 9:
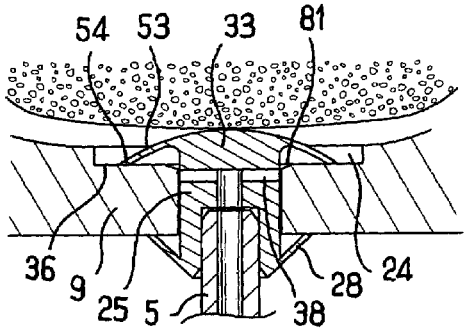

In the exemplary embodiment shown in FIG. 9, the wall of the unit 3 that bears the filling valve 20 may comprise, for example, at least one recess 81, especially of conical shape, for helping the product flow into the depression 24. As appropriate, the orifices 38 may open out into the recess 81 when the valve is in its closed configuration, a sealed closure being obtained, for example, by the head 33, especially the lip 53, pressing against the bottom of the depression.

Figure 10:
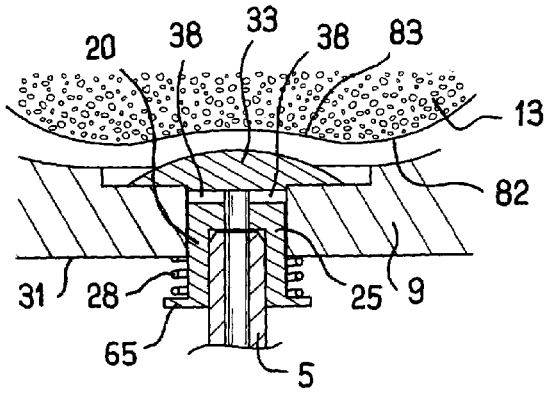

The element 13 may be made with an application face 82 having at least one hollow 83 for accumulating product, as illustrated in FIG. 10, for example.

Figure 11:
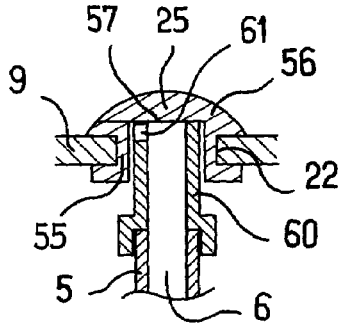
Figure 12:
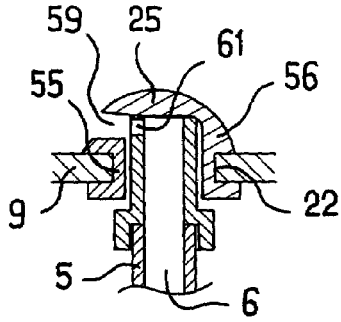

In the exemplary embodiment illustrated in FIGS. 11 and 12, the filling valve 20 comprises a fixed part 55, engaged in the aperture 22, and a stopper-forming part 25 that can move relative to the fixed part 55, for example, because the stopper-forming part 25 is connected to the fixed part 55 via a hinge-forming part 56.

When the filling valve 20 is in the rest configuration, the stopper-forming part 25 can press in a leaktight manner against the fixed part 55, for example, as illustrated in FIG. 11.

When a thrust is exerted by the stem 5 of the container on the inside face 57 of the stopper-forming part 25, the latter can rise and form, with the fixed part 55, an aperture 59 allowing the product to reach the internal space 12 of the refillable unit 3. The stem 5 can press directly against the face 57 but, as illustrated in this embodiment, the stem 5 may be equipped at its end with an endpiece 60 that may comprise a lateral aperture 61 for dispensing the product coming from the inner duct 6 of the stem 5 directly into the aperture 59, allowing the product to flow more easily. As appropriate, the stem 5 may have, at its free end, one or more lateral apertures, such as the aperture 61. In embodiments, the face 57 of the stopper-forming part 25 may be made with a shape that facilitates the flow of the product from the inner duct 6 of the stem 5 when the stem 5 bears against the stopper-forming part 25.

Figure 13:
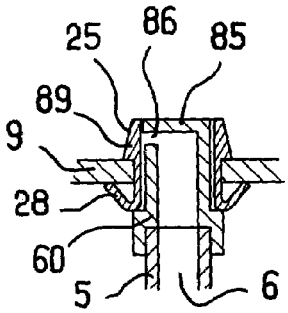

In the exemplary embodiment of FIG. 13, the filling valve 20 comprises an endpiece 60 whose lower part is shaped to fit over the stem 5 and having at its upper part a sprayer-forming part 85, comprising a lateral product outlet orifice 86.

In this exemplary embodiment, the filling valve 20 also comprises a return member 28 made as a single piece by moulding a plastic, for example, an elastomer, with a stopper-forming part 25.

In the exemplary embodiment illustrated, the return member 28 is in the shape of a flexible lip bearing against the outer surface 31 of the body 9.

The stopper-forming part 25 is in the form of a sleeve having a conical flange 89 for retaining the stopper-forming part 25 on the inside surface of the body 9 when the stem 5 is withdrawn.

In the closed configuration, the orifice 86 is closed off by the sleeve.

In the dispensing configuration, the lip 28 is deformed and the orifice 86 opens out outside of the sleeve.

Figure 14:
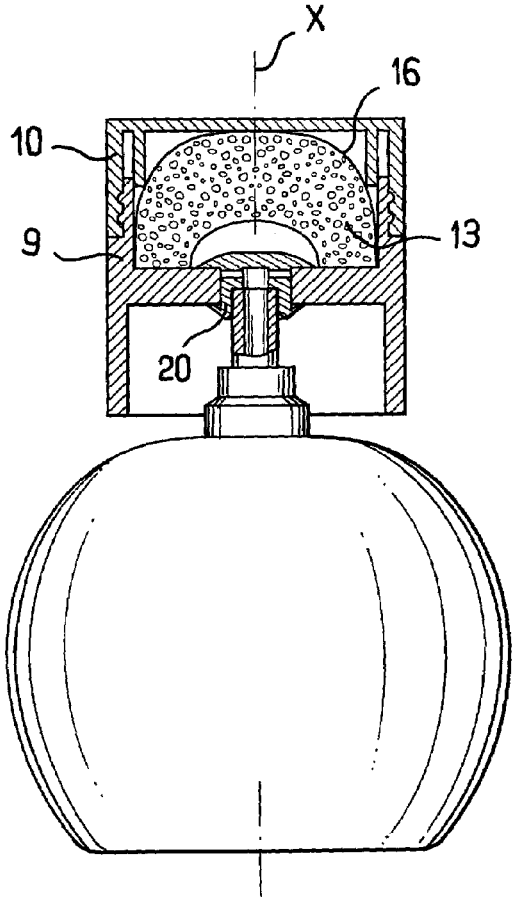
FIG. 14 is a schematic view, in partial longitudinal section, of another embodiment of a device according to the invention.

The applicator member 13 may alternatively not be integral with the cover 10, but integral with the body 9, as illustrated in FIG. 14. In this case, the product may, for example, pass through the applicator member 13, owing to the porosity of the latter, to reach the surface 16 for application.

Figure 15:
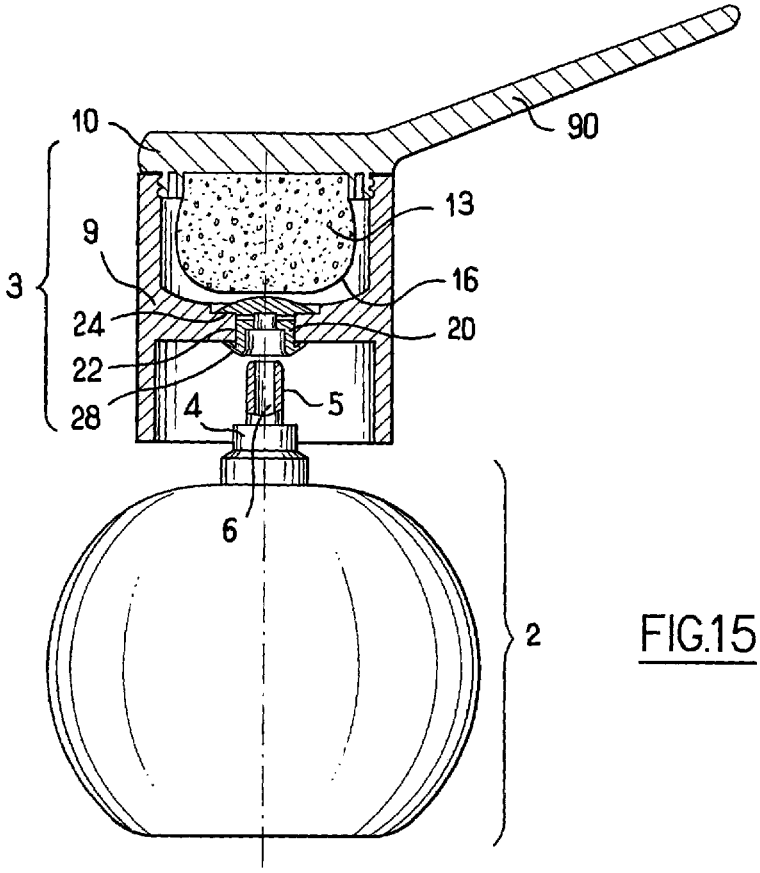
FIG. 15 is a schematic view, in partial longitudinal section, of another embodiment of a device according to the invention.

In another exemplary embodiment shown in FIG. 15, the cover 10 comprises a handle 90 designed to make it easier for the user to grip and manipulate the refillable element.

Figure 16:
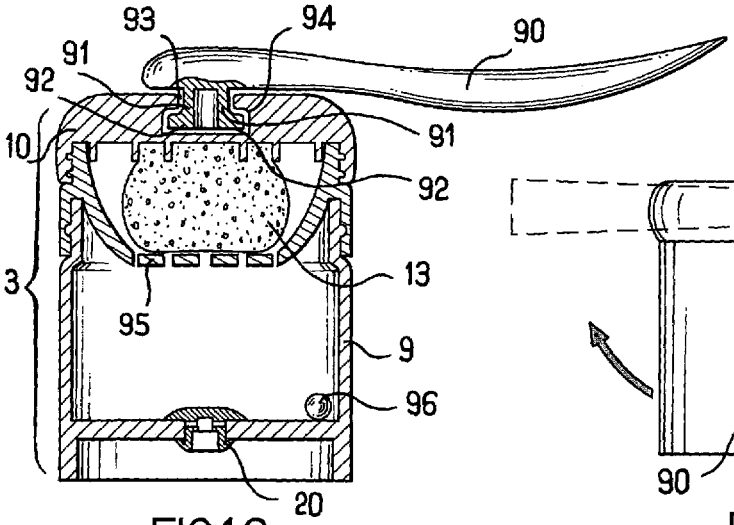
FIG. 16 is a schematic view, in partial longitudinal section, of another embodiment of a refillable unit.

The handle 90 may be non-removable, as illustrated in FIG. 15, or may be removable, as illustrated in FIG. 16. In FIG. 16, the handle 90 comprises at least two elastically deformable tabs 91 with bulges 92 at the bottom. The cover 10 of the refillable unit comprises an opening 93 and at least one groove 94 designed as a housing for snap-fitting the tabs 91.

Also in FIG. 16, an element bearing a grid 95 is inserted between the cover 10 and the body 9 of the refillable unit. The applicator member 13 takes up product through the grid 95, the product being contained in the body 9 after filling through the valve 20 located in its bottom. The body 9 contains a ball 96 for homogenizing the product contained therein.

Figure 17:
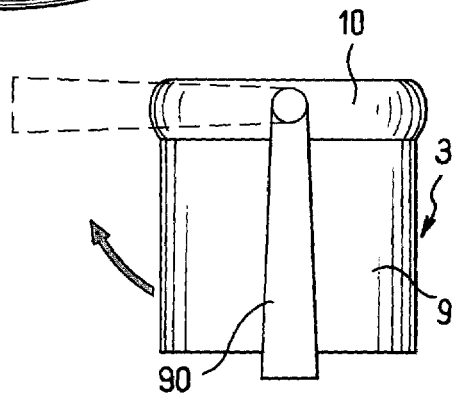
FIG. 17 is a schematic side view of another embodiment of a refillable unit.

In another exemplary embodiment illustrated in FIG. 17, the handle 90 may also be foldable.

As shown in FIG. 17, a refillable unit 3 may be surmounted by a cover 10, on the periphery of which is fastened a yoke-shaped handle 90.

The handle 90, as illustrated, may be folded under the unit and may, for example, help keep the cover 10 on the body 9. The handle may be rotated in the direction of the arrow and positioned, for example, horizontally, as shown in dotted lines.

Figure 18:
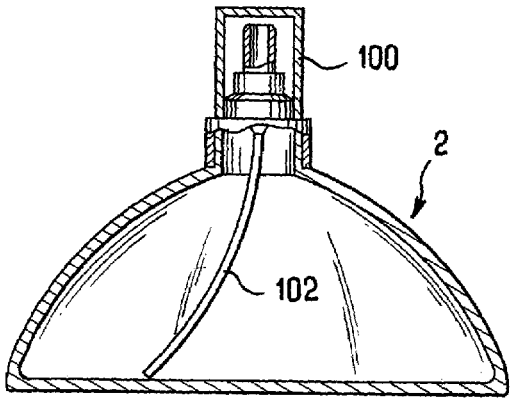
FIGS. 18 and 19 show various embodiments of the container.
Figure 19:
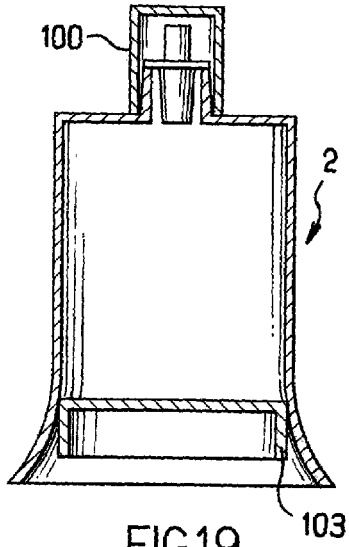

The container 2 may have various shapes, different from that of FIG. 1, such as a downwardly flared shape, as illustrated in FIG. 18, or a substantially cylindrical shape, as illustrated in FIG. 19.

In the absence of the refillable unit, the container 2 may be surmounted by a closure cap 100 designed to protect the dispenser member 4.

The container 2 shown in FIG. 18 comprises a pump 100 and a dip tube 102. The container 2 is designed to contain a liquid product such as, for example, a milk or a gelled lotion.

The container 2 shown in FIG. 19 may contain, for example, a more pasty product, such as a cream gel, and comprises a piston 103 in the bottom of the container 2.

The pump 100 of the container 2 of FIG. 19 is an airless pump, so that the piston 103 rises up in the container as the product is dispensed. The piston 103 may be replaced by a contractible bag, for example.

Figure 20:
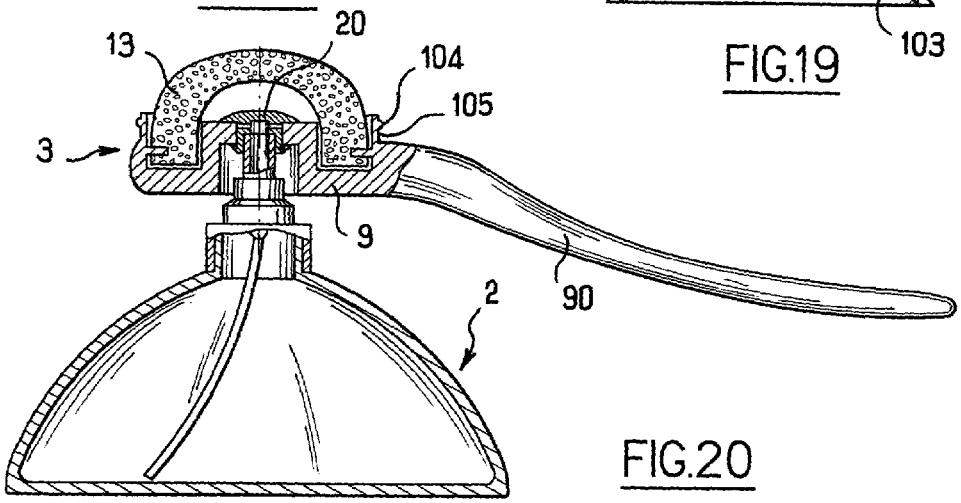
FIG. 20 shows an embodiment of a device according to the invention comprising the container of FIG. 18.

The refillable unit 3, shown in FIG. 20 mounted on the container 2, comprises, like the exemplary embodiment of FIG. 14, an applicator member 13 that is integral with the body 9. The body 9 is extended by a handle 90. The body 9 comprises a skirt 105 equipped with an annular rib 104 designed to be housed, as illustrated in FIG. 21, in a corresponding groove in the cover 10, which cover may optionally be placed on the unit 3 when the product is dispensed using the valve 20.

Figure 21:
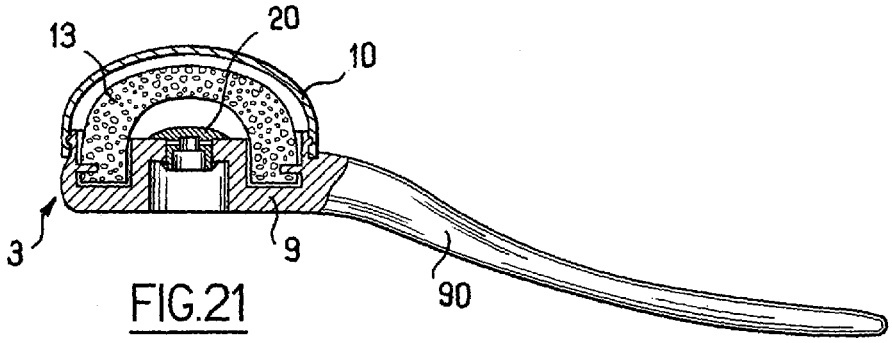
FIG. 21 is a schematic view, in partial longitudinal section, of the refillable unit of FIG. 20.

In another embodiment (not shown), the device shown in FIGS. 20 and 21 may lack a cover 10, without departing from the scope of the present invention.

Naturally, the invention is not limited to the examples described above.

The product-refillable element may, for example, not be an applicator member, and may comprise, for example, a foam that can store the product and release the product when the element is compressed.

Throughout the description, including the claims, the expression "comprising a" must be understood as being synonymous with "comprising at least one," unless specified otherwise.

The features of the various embodiments may be combined. In particular, it is possible to equip the device of FIG. 14 with a filling valve shown in one of FIGS. 4 to 13.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for packaging and dispensing a product, said device comprising:

a unit that can be refilled with product using a container having a dispenser member comprising a hollow stem, said unit comprising:

a body;

an element that can be refilled with the product, the element comprising a product application surface;

a filling valve that is attached to said body and configured to pass from a closed configuration to a filling configuration under an effect of a thrust exerted by the dispenser member, and to return to the closed configuration in the absence of the dispenser member, the filling valve comprising a portion movable relative to the body, the portion defining a housing for receiving the hollow stem, the filling valve comprising an inner duct opening at an end of the housing, the inner duct communicating with at least one orifice of the filling valve and allowing the product to flow from the hollow stem into the unit in a filling configuration.

2. A device according to claim 1, wherein the hollow stem is a valve stem.

3. A device according to claim 1, wherein the hollow stem is a pump stem.

4. A device according to claim 2, wherein the hollow stem is movable with respect to the container along an axis between a rest position and a position for dispensing the product.

5. A device according to claim 4, wherein the force necessary to cause the filling valve to go from the closed configuration to the filling configuration is less than or equal to the force necessary to make the hollow stem pass from the rest position to the dispensing position.

6. A device according to claim 4, wherein the force necessary to cause the hollow stem to pass from the rest position to the dispensing position is between about 10 daN and about 15 daN.

7. A device according to claim 1, wherein the filling valve is configured to take up the filling configuration before the dispenser member delivers any product into the refillable unit.

8. A device according to claim 1, wherein the filling valve is made as a single piece by moulding a material.

9. A device according to claim 1, wherein the filling valve is made as a single piece by moulding an elastomer.

10. A device according to claim 1, wherein the filling valve is made by assembling several components.

11. A device according to claim 1, wherein the filling valve is attached to the body of the refillable unit.

12. A device according to claim 11, wherein the body of the refillable unit has an aperture passing therethrough, the filling valve being placed in the aperture.

13. A device according to claim 12, wherein the aperture is located in a depression opening out into an internal space of the unit.

14. A device according to claim 13, wherein the filling valve does not protrude from the depression.

15. A device according to claim 1, wherein there is no contact between the filling valve and the product-refillable element.

16. A device according to claim 1, wherein the filling valve comprises an elastic return member for returning the filling member to the closed configuration when the dispenser member of the container is uncoupled from the filling valve.

17. A device according to claim 16, wherein the elastic return member is in the form of a lip made as a single piece with a stopper-forming part of the filling valve.

18. A device according to claim 16, wherein the return member is in the form of a spring that is not made as a single piece with a stopper-forming part of the valve.

19. A device according to claim 18, wherein the return member is a helical spring that is elastically interposed between an outer surface of the body and a shoulder made on the stopper-forming part of the filling valve.

20. A device according to claim 1, wherein the filling valve comprises a stopper-forming part that comprises at least one orifice that is closed off by the body of the refillable unit when the valve is in the closed configuration and that opens out into the internal space when the valve is in the filling configuration.

21. A device according to claim 20, wherein the stopper-forming part comprises at least two diametrically opposed and coaxial orifices.

22. A device according to claim 1, wherein the filling valve comprises a stopper-forming part that comprises at least one boss making it possible to reduce the extent of the contacting surfaces of the filling valve and of the body.

23. A device according to claim 22, wherein the filling valve comprises at least one annular boss.

24. A device according to claim 23, wherein the filling valve comprises at least two annular bosses.

25. A device according to claim 23, wherein the annular boss is placed on a side of the orifice through which the product passes before reaching the internal space.

26. A device according to claim 24, wherein the two annular bosses are placed on either side of the orifices through which the product passes before reaching the internal space.

27. A device according to claim 1, wherein the filling valve comprises a fixed part placed in an aperture of the body and a stopper-forming part that can move relative to the fixed part under the effect of a thrust exerted by the dispenser member of the container.

28. A device according to claim 27, wherein the stopper-forming part can move relative to the fixed part under the effect of a thrust exerted by the hollow stem of at least one of a pump and a valve bearing against the stopper-forming part so as to push the stopper-forming part away from the fixed part.

29. A device according to claim 1, wherein the filling valve comprises an endpiece designed to cooperate with the dispenser member, the endpiece being movable relative to an elastomer part.

30. A device according to claim 29, wherein the stopper-forming part is articulated to the fixed part via a hinge-forming part.

31. A device according to claim 1, wherein the filling valve comprises a head for retaining the filling valve in the body of the refillable unit.

32. A device according to claim 1, wherein the head has a wall that is thinner at its periphery.

33. A device according to claim 1, wherein the product-refillable element in the unit consists of an applicator member.

34. A device according to claim 33, further comprising a member for gripping the applicator member fastened removably to the body.

35. A device according to claim 33, wherein the applicator member is integral with the body during application.

36. A device according to claim 33, wherein the applicator member comprises an elastically deformable element.

37. A device according to claim 36, wherein the elastically deformable element comprises a foam.

38. A device according to claim 1, wherein the unit comprises a handle.

39. A device according to claim 38, wherein the handle is removable.

40. A device according to claim 38, wherein the handle is foldable.

41. A device according to claim 1, wherein the unit comprises a grid inserted between the product-refillable element and the filling valve.

42. A device according to claim 1, wherein the container comprises a dip tube.

43. A device according to claim 1, wherein the container comprises a piston and wherein the container comprises a dispenser member.

44. A device according to claim 43, wherein the dispenser member comprises an airless pump.

* * * * *